United States Patent [19]

Tange

[11] Patent Number: 4,999,678

[45] Date of Patent: Mar. 12, 1991

[54] CLEANING APPARATUS FOR CLEANING THE SURFACE OF A PHOTOSENSITIVE MEMBER

[75] Inventor: Keigo Tange, Osaka, Japan

[73] Assignee: Minolta Camera Kabushiki Kaisha, Osaka, Japan

[21] Appl. No.: 301,869

[22] Filed: Jan. 25, 1989

[30] Foreign Application Priority Data

Jan. 26, 1988 [JP] Japan ..... 63-9113[U]

[51] Int. Cl.[5] ..... G03G 21/00

[52] U.S. Cl. ..... 355/297; 15/256.53

[58] Field of Search ..... 355/296, 297, 299, 211, 355/301, 302; 118/652; 15/256.53

[56] References Cited

U.S. PATENT DOCUMENTS

| | | | |
|---|---|---|---|
| 3,724,020 | 4/1973 | Till | 15/256.53 |
| 3,947,108 | 3/1976 | Thettu | 355/297 |
| 3,950,092 | 4/1976 | Zoltner | 355/15 |

FOREIGN PATENT DOCUMENTS

| | | | |
|---|---|---|---|
| 59-206860 | 11/1984 | Japan | 355/301 |

*Primary Examiner*—Joan H. Pendegrass

*Attorney, Agent, or Firm*—Willian Brinks Olds Hofer Gilson & Lione

[57] ABSTRACT

A cleaning apparatus for cleaning the surface of a photosensitive member having a cleaning blade, and a cleaning roller which is disposed on the upstream side of the cleaning blade with respect to the rotational direction of the photosensitive member, and is moved laterally as to the rotational axis thereof by the driving power that rotates the same.

11 Claims, 4 Drawing Sheets

CLEANING APPARATUS FOR CLEANING THE SURFACE OF A PHOTOSENSITIVE MEMBER

BACKGROUND OF THE INVENTION

1. Field of the Invention

The present invention relates to a cleaning apparatus which removes residual toner and the like from the surface of a photosensitive member used in electrophotographic copy machines and the like.

2. Description of Related Arts

Image forming apparatus of conventional electrophotographic copy machines which repeat a process wherein a toner image formed on the surface of a photosensitive member is transferred to a transfer medium must clean residual toner, paper particles and talc from the surface of said photosensitive member after each transfer process. Accordingly, a variety of conventional cleaning apparatus have been proposed, such as cleaning blade, cleaning roller, fur brush, web and the like. Among the aforesaid devices, a cleaning roller disposed upstream of a cleaning blade has also been proposed in U.S. Pat. No. 3,950,092. In the cleaning apparatus disclosed in the aforesaid patent, a cleaning roller supplements the cleaning action of a cleaning blade, and performs the function of transporting the residual toner and other material scraped off by said cleaning blade to a toner sump portion without said waste toner escaping to the interior of the copy machine. Toner on the cleaning roller is removed therefrom by a scraper which rides in pressure contact with said cleaning roller, the toner then being transmitted to a toner sump.

In the cleaning apparatus disclosed in the aforesaid U.S. Pat. No. 3,950,092 which provides a cleaning roller in addition to a cleaning blade, when foreign material originating from the copy paper, plastic components within the machine, textile fragments from the drive belt or the like become interposed between the photosensitive member and said cleaning roller, or between the scraper and said cleaning roller, the surface of the photosensitive member is incompletely cleaned causing the surface of said member to be damaged and preventing appropriate copy images from being made. Thus, uniform cleaning cannot be accomplished when the aforesaid foreign matter induces irregularities to form on the surfaces of the photosensitive member and cleaning roller as a result of the pressure contact between said surfaces while the cleaning roller is rotated with said foreign matter interposed therebetween, thereby causing the production of ghost images, streaking, uneven density, and fogging to appear on the copy paper.

SUMMARY OF THE INVENTION

Accordingly, a main object of the present invention is to provide a superior cleaning apparatus which eliminates the previously described disadvantages.

A further object of the present invention is to provide a cleaning apparatus which eliminates the detrimental effects on the copy image produced by the flawed surface of the photosensitive member which occurs when foreign matter becomes lodged between said photosensitive member and the cleaning roller while residual toner is cleaned from the surface of said photosensitive member.

A still further object of the present invention is to construct a cleaning apparatus which eliminates the aforesaid disadvantages by means of a simple system.

These and other objects are attained by a cleaning apparatus comprising a cleaning blade which rides in pressure contact with the surface of a photosensitive member, a rotatable cleaning roller disposed upstream of the aforesaid cleaning blade and which also makes pressure contact with the surface of said photosensitive member and is maintained so as to be movable laterally relative to the rotational axis of said photosensitive member, and a single drive source which drives cleaning roller rotation and lateral movement.

In one aspect of the present invention, the cleaning apparatus comprises a cleaning blade maintained so as to be laterally moveable relative to the rotational axis of the photosensitive member, a rotatable cleaning roller disposed upstream of the cleaning blade and which comes into pressure contact with the surface of the photosensitive member, and which is maintained so as to be laterally movable relative to the rotational axis of the photosensitive member, and a means for accomplishing reciprocal lateral movement of said cleaning blade and cleaning roller by means of a single power source which also rotates said cleaning roller.

BRIEF DESCRIPTION OF THE DRAWINGS

These and other objects or features of the present invention will become apparent from the following description of the preferred embodiments thereof taken in conjunction with the accompanying drawings, in which.

Figure 5:
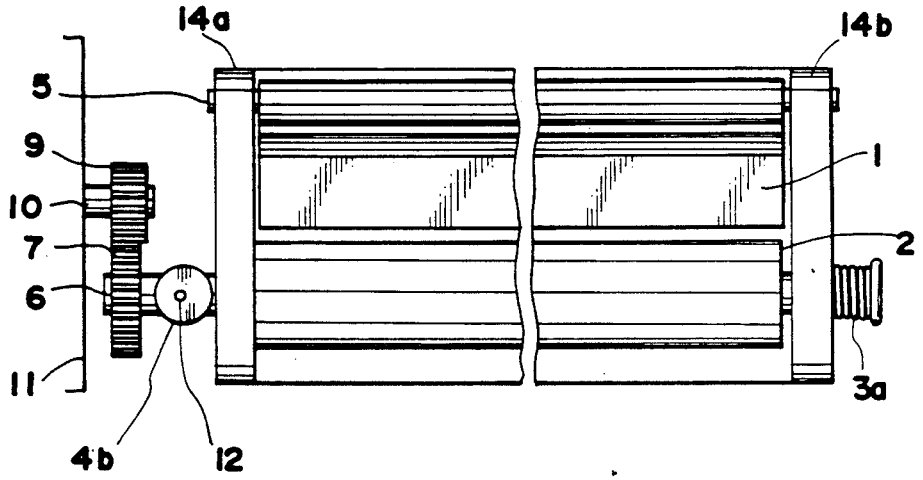

FIGS. *7a*, *7b* and 8 show modifications of the eccentric cam in the cleaning apparatus shown in FIG. 5.

In the following description, like parts are designated by like reference numbers throughout the several drawings.

DESCRIPTION OF THE PREFERRED EMBODIMENTS

Figure 1:
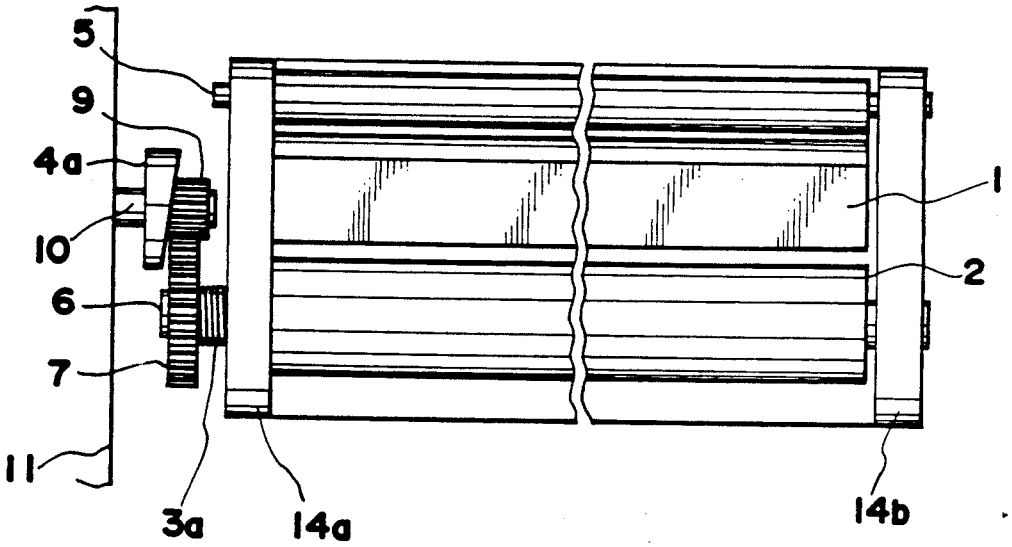
FIG. 1 is an elevation view of the cleaning apparatus of the present invention.
Figure 2:
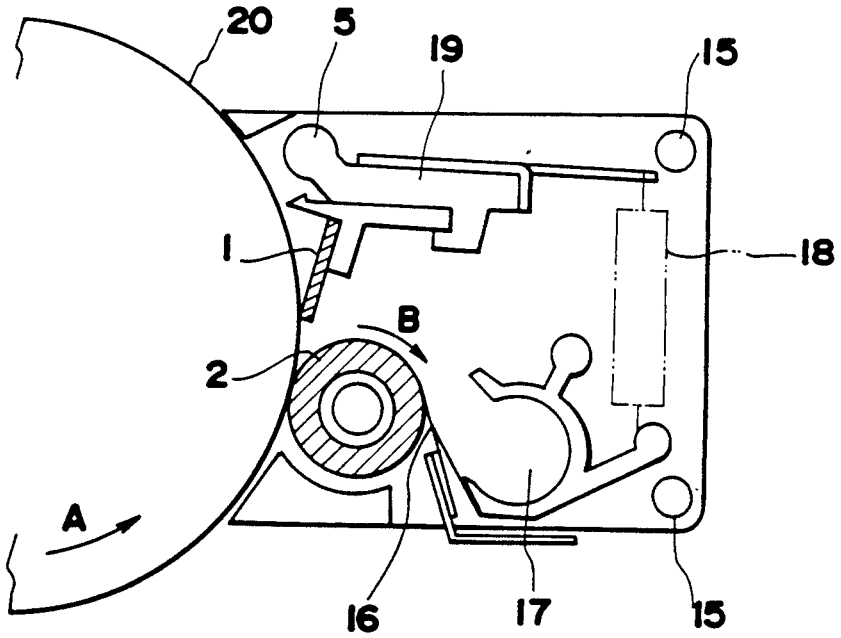
FIG. 2 is a cross section view of the photosensitive member and cleaning apparatus of the present invention.

Embodiments of the cleaning apparatus of the present invention are explained hereinafter with reference to the accompanying drawings. FIG. 1 is an elevation view of one embodiment of the cleaning apparatus of the present invention as seen from the photosensitive member side, while FIG. 2 is a cross section view sectioned vertically on the rotational axis of the photosensitive member. The present embodiment of the cleaning apparatus employs both cleaning blade 1 and cleaning roller 2 as cleaning members. Cleaning blade 1 is supported by blade support member 19 which is rotatable about blade shaft 5 supported by unit side panels 14*a* and 14*b*, and makes pressure contact with the surface of photosensitive member 20 via pressure applied by pressure spring 18 mounted on said support member 19. Cleaning roller 2 is laterally movable on roller shaft 6 in the axial direction and is maintained between the two unit side panels 14a and 14b so as to be rotatable therebetween, and is so disposed on the upstream side of cleaning blade 1 as to make pressure contact with said photosensitive member 20 by means of a pressure applying means not shown in the drawing. Cleaning roller 2 is rotatably driven about roller shaft 6 via roller gear 7 which is linked to drive gear 9 fixedly mounted to drive gear shaft 10 of a drive source not shown in the drawing. The aforesaid cleaning roller 2, as previously described, removes a portion of the residual toner and foreign particulate matter from the surface of photosensitive member 20 which rotates in the direction of arrow "A," as shown in FIG. 2, and also transports residual toner and foreign particulate matter scraped off said member 20 by cleaning blade 1 disposed downstream therefrom to a toner sump portion 17. At that time, unnecessary particulate matter carried on cleaning roller 2 is scraped off by scraper 16 which makes pressure contact with the surface of said roller 2.

Next follows an explanation of the mechanism which provides the combined rotational drive forces for cleaning roller 2 to accomplish lateral movement of said cleaning roller 2 in a parallel direction to the rotational axis of photosensitive member 20. First, a coil spring 3a is provided about roller shaft 6 which is interposed between roller gear 7 and unit side panel 14a fixedly mounted relative to copy machine housing 11. An inclined-face cam 4a is fixedly mounted on drive gear shaft 10 with the same axis in such a way that the inclined face of said cam 4a abuts the left side of roller gear 7, as shown in the drawing. In the aforesaid construction, cleaning roller 2 is normally pressed leftwardly in the drawing via the force exerted by coil spring 3a. In this state, when drive gear shaft 10 is rotated to rotationally drive cleaning roller 2, said cleaning roller 2 moves laterally in reciprocal motion because inclined-face cam 4a is also rotated in tandem with said drive gear shaft 10.

Figure 3:
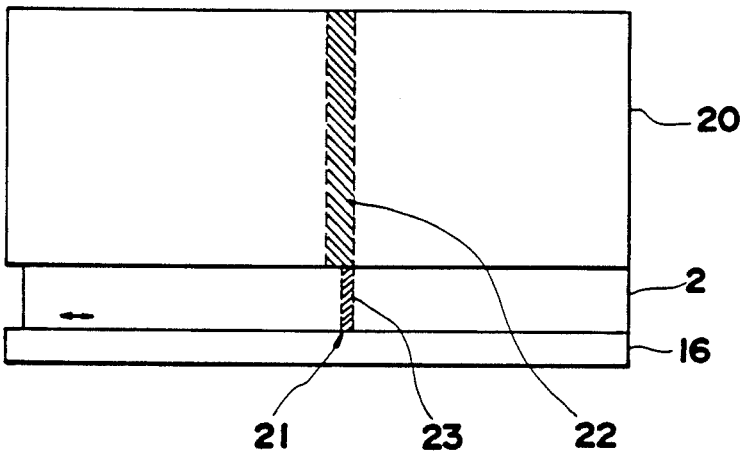
FIG. 3 shows flaw propagation caused by foreign matter lodged between the photosensitive member, cleaning roller and scraper respectively.

An explanation follows hereinafter on the effect of damage to the surface of photosensitive member 20 caused by foreign matter lodged between cleaning roller 2 and scraper 16 as relates to the lateral movement of said cleaning roller 2. FIG. 3 illustrates the relative positional relationships of photosensitive member 20, cleaning roller 2 and scraper 16. In the present embodiment, the center cleaning roller 2 rotates as it moves laterally. If the rotational and lateral movement cycles of cleaning roller 2 are dissimilar at this time, foreign matter 21 (indicated by black triangles in FIG. 3) on the scraper creates a flaw 23 having a width equal to the lateral movement of the roller on the circumference thereof, and subsequently creates a damaged region 22 on the surface of the photosensitive member 20 having a width double the lateral movement of cleaning roller 2. If, however, cleaning roller 2 does not move laterally, damage to the photosensitive member 20 and cleaning roller 2 caused by said foreign matter 21 occurs in the form of a single deep groove which is ruinous to the copy image. That is, the flaw on cleaning roller 2 and the damage region on photosensitive member 20, which are caused by foreign matter in conjunction with the lateral movement of said cleaning roller 2, are broadly dispersed so as to produce almost no effect on the copy image. If attempting to obtain a similar effect by laterally moving the scraper 16 rather than the cleaning roller 2, construction becomes impractical since scraper 16 must be laterally moved twice the distance of cleaning roller 2. Further, there also will be a similar dispersion of damage to the photosensitive member caused by the foreign matter when said foreign matter becomes lodged between cleaning roller 2 and photosensitive member 20.

Figure 4:
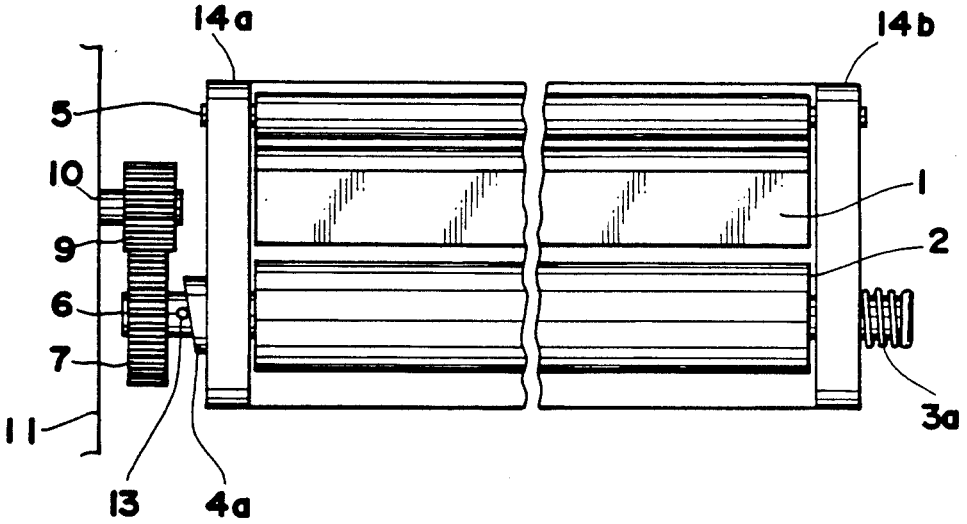
FIGS. 4, 5, 9 and 10 are elevation views of other embodiments of the cleaning apparatus of the present invention.

A description of a second embodiment of the invention follows hereafter with reference to FIG. 4. FIG. 4 is an elevation view of the cleaning apparatus as seen from the photosensitive member side, as described in FIG. 1, and has a cross section view sectioned vertically on the rotational axis of the photosensitive member of the cleaning apparatus which is identical to that described in FIG. 2. The present embodiment differs from the previously described First Embodiment only in the mechanism by which the lateral movement of cleaning roller 2 is accomplished. The salient points of the system for achieving lateral movement in the Second Embodiment are that the right side of cleaning roller 2, as shown in FIG. 4, has spring force applied thereto by coil spring 3a disposed medially between the outer side of roller shaft 6 side panel 14b and a roller shaft 6 flange portion, and roller shaft 6 rotates and cleaning roller 2 is moved laterally by means of the inclined face of inclined-face cam 4a fixedly attached to unit side panel 14a and pin 13 provided on roller shaft 6 and which make contact with said inclined face of cam 4a.

Figure 7A:
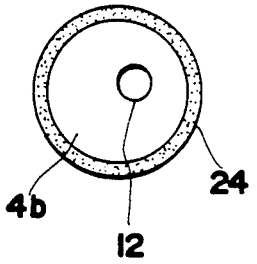
Figure 7B:
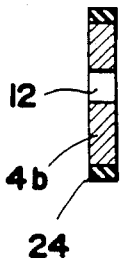
Figure 6:
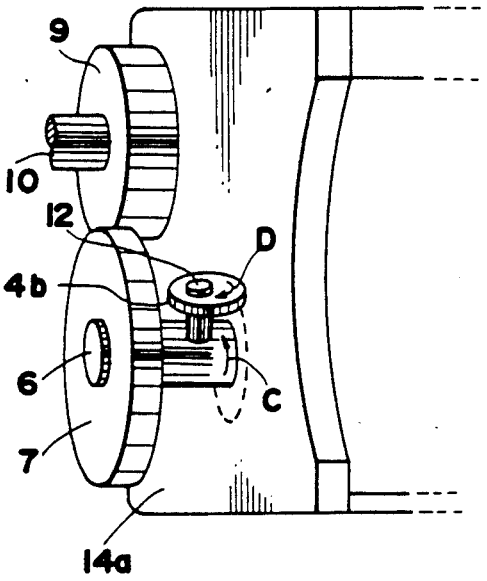
FIG. 6 is a perspective view showing the operation of the eccentric cam in the cleaning apparatus shown in FIG. 5.
Figure 8:
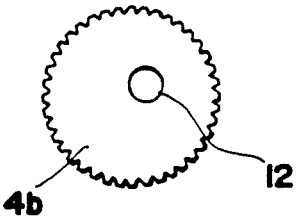

A Third Embodiment of the present invention is hereinafter described with reference to FIGS. 5 through 8. FIG. 5 is an elevation view of the cleaning apparatus identical to that shown in FIG. 4, and the cross section of said apparatus is identical to that shown in FIG. 2. The present embodiment differs from the First and Second Embodiments only in the mechanism by which the lateral movement of cleaning roller 2 is accomplished. The salient points of the system for achieving lateral movement in the Third Embodiment are that the right side of cleaning roller 2, as shown in FIG. 5, has spring force applied thereto by coil spring 3a disposed medially between the outer side of roller shaft 6 side panel 14b and a roller shaft 6 flange portion, and roller shaft 6 rotates and cleaning roller 2 is moved laterally by means of an eccentric cam 4b rotatably mounted on roller shaft 6 by a cam shaft 12 which is perpendicular to the rotational axis of said roller shaft 6, said eccentric cam 4b also abutting unit side panel 14a. That is, more specifically, when roller shaft 6 is rotated in the direction of arrow "C" in FIG. 6, eccentric cam 4b directly contacts unit side panel 14a and is rotated in the direction of arrow "D" due to the force applied by coil spring 3a and the frictional force arising between said eccentric cam 4b and the surface of unit side panel 14a while also rotating in the manner described by the dotted line in the drawing, thereby causing the lateral movement of cleaning roller 2. To obtain the aforesaid frictional force during the above described operation, a friction member 24 formed of rubber or like material may be provided on the surface of eccentric cam 4b which comes into contact with the unit side panel 14a, as shown in FIG. 7, or the circumferential edge of said eccentric cam 4b may be formed so as to have a toothed configuration which meshes with a gear-engaging configuration provided on unit side panel 14a.

Figure 9:
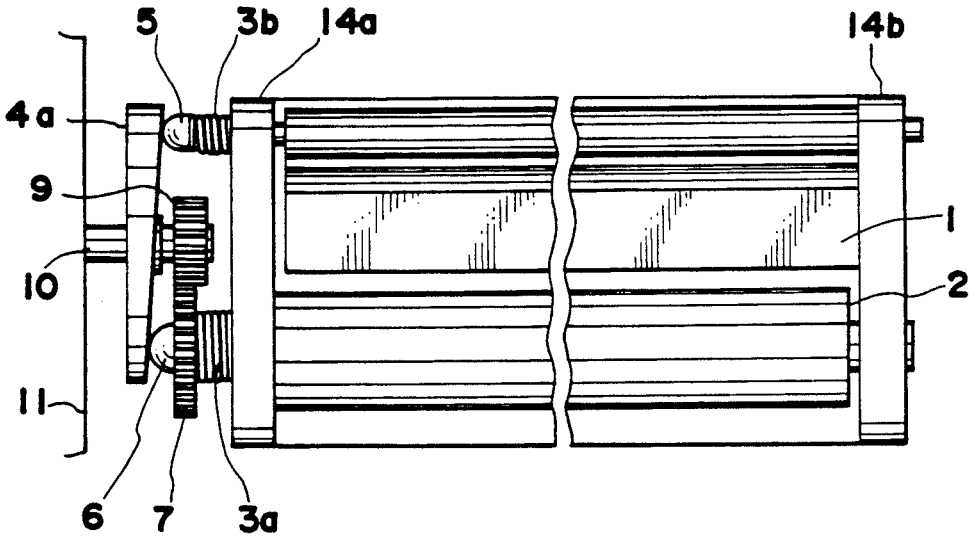
Figure 10:
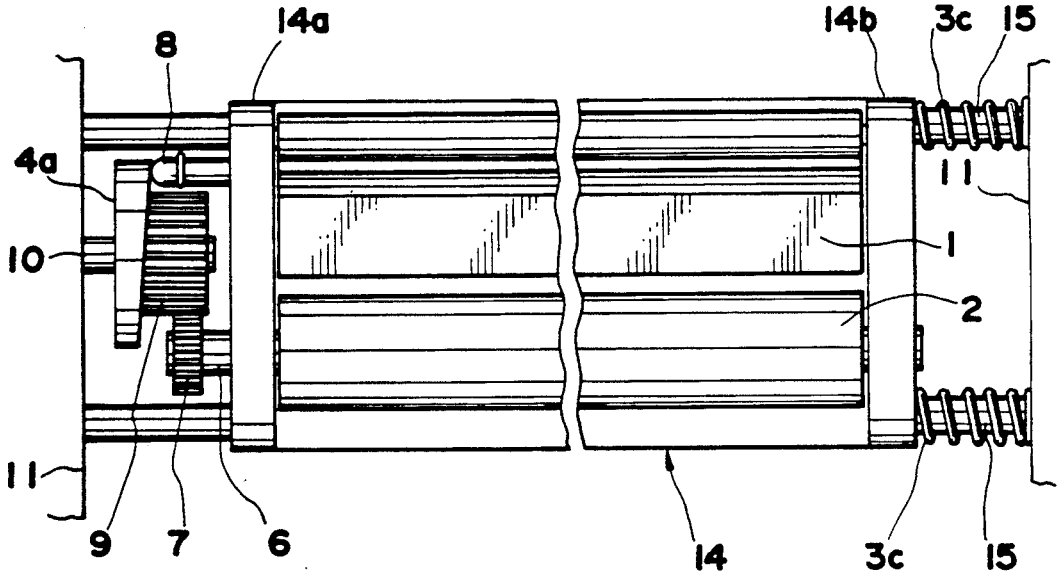

Hereinafter follows descriptions of the Fourth and Fifth Embodiments of the present invention with reference to FIGS. 9 and 10 respectively. FIGS. 9 and 10 are elevation views of the cleaning apparatus similar to that shown in FIG. 1, and their cross sections are the same as that shown in FIG. 2. These two embodiments differ not only in the mechanism by which the lateral movement of cleaning roller 2 is achieved, but also in that cleaning blade 1 also moves laterally via the rotational drive source for cleaning roller 2. First, in the Fourth Embodiment shown in FIG. 9, drive gear shaft 10 which rotates cleaning roller 2 has attached thereto a large diameter inclined-face cam 4*a* in addition to a drive gear 9 which supplies a drive force to roller gear 7 on roller shaft 6. Roller shaft 6 and blade shaft 5 abut inclined-face cam 4*a* and apply spring force thereto in a leftward direction as indicated in FIG. 9 by means of coil springs 3*a* and 3*b* respectively. Accordingly, when drive gear 10 is rotated to rotate cleaning roller 2 through roller gear 7 and drive gear 9, inclined-face cam 4*a* also rotates simultaneously, thereby laterally moving both cleaning roller 2 and cleaning blade 1. The Fifth Embodiment shown in FIG. 10 comprises a cleaning blade 1 and cleaning roller 2 which are both fixedly maintained by cleaning unit 14, the casing of said cleaning unit being supported so as to be laterally movable on shafts 15 fixedly mounted to copy machine frame 11. Lateral movement pin 8 provided on unit side panel 14*a* abuts inclined-face cam 4*a* attached to the drive shaft which rotates cleaning roller 2, and the cleaning unit mechanism moves laterally with the rotation of inclined-face cam 4*a* by means of the leftwardly (in FIG. 10) applied spring force of coil spring 3*c* provided on shaft 15 at the outside of unit panel 14*b*.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A cleaning apparatus for cleaning a surface of a photosensitive member, comprising:
   - a cleaning blade disposed in pressure contact with the surface of the photosensitive member;
   - a cleaning roller disposed on the upstream side of said cleaning blade with respect to the rotational direction of the photosensitive member, and being rotatable and movable laterally as to the rotational axis thereof under pressure contact with the surface of the photosensitive member;
   - a scraper disposed in pressure contact with the surface of the cleaning roller;
   - a single drive source to supply driving power;
   - a first transmission means for transmitting the driving power of said single drive source to said cleaning roller to rotate the same; and
   - a second transmission means for transmitting the driving power of said single drive source to said cleaning roller to move the same laterally, whereby the cleaning roller and the scraper are moved relative to each other.

2. A cleaning apparatus of claim 1, wherein said cleaning blade is movable laterally as to the longitudinal direction thereof, and further comprising:
   - a third transmission means for transmitting the driving power of said single drive source to said cleaning blade to move the same laterally.

3. A cleaning apparatus of claim 1, wherein said first transmission means includes a first gear which is fixedly mounted on an axis of said single drive source and a second gear which is linked to said first gear and is fixedly mounted on said cleaning roller, and wherein said second transmission means includes an inclined-face cam which is fixedly mounted on the axis of said single drive source, and one end of the rotational axis of said cleaning roller is pressed against the inclined face of said inclined-face cam so as to shift in lateral direction according to the rotation of said cam.

4. A cleaning apparatus of claim 1, wherein said first transmission means transmits the driving power via a gear, and wherein said second transmission means transmits the driving power via a cam.

5. A cleaning apparatus of claim 4, wherein said cam is an inclined-face cam.

6. A cleaning apparatus of claim 4, wherein said cam is an eccentric cam.

7. A cleaning apparatus for cleaning the surface of a photosensitive member, comprising:
   - a cleaning blade disposed in pressure contact with the surface of the photosensitive member and being movable laterally as to the longitudinal direction thereof;
   - a cleaning roller disposed on the upstream side of said cleaning blade with respect to the rotational direction of the photosensitive member, and being rotatable and movable laterally as to the rotational axis thereof under pressure contact with the surface of the photosensitive member;
   - a scraper disposed in pressure contact with the surface of the cleaning roller;
   - a single drive source to supply driving power;
   - a first transmission means for transmitting the driving power of said single drive source to said cleaning roller to rotate the same; and
   - a second transmission means for transmitting the driving power of said single drive source to both of said cleaning roller and said cleaning blade so that said cleaning roller and said cleaning blade are respectively moved laterally, whereby the cleaning roller and the scraper are moved relative to each other.

8. A cleaning apparatus of claim 7, wherein said first transmission means transmits the driving power via a gear, and wherein said second transmission means transmits the driving power via a cam.

9. A cleaning apparatus of claim 8, wherein said cam is an inclined-face cam.

10. A cleaning apparatus of claim 8, wherein said cam is an eccentric cam.

11. A cleaning apparatus of claim 7, wherein said first transmission means includes a first gear which is fixedly mounted on the axis of said single drive source and a second gear which is linked to said first gear and is fixedly mounted on the rotational axis of said cleaning roller, wherein said second transmission means includes an inclined-face cam which is fixedly mounted on the axis of said single drive source, and one end of each said cleaning roller and cleaning blade is pressed against the inclined face of said inclined-face cam so as to shift in lateral direction according to the rotation of said cam.

* * * * *